US010886057B2

(12) United States Patent
Aoki et al.

(10) Patent No.: US 10,886,057 B2
(45) Date of Patent: Jan. 5, 2021

(54) ELECTRONIC COMPONENT

(71) Applicant: TDK CORPORATION, Tokyo (JP)

(72) Inventors: Shunji Aoki, Tokyo (JP); Yuya Ishima, Tokyo (JP); Makoto Takahashi, Tokyo (JP); Shougo Okamoto, Tokyo (JP); Takafumi Takahashi, Yuri-Honjo (JP); Hajime Kato, Tokyo (JP); Yuto Shiga, Tokyo (JP)

(73) Assignee: TDK CORPORATION, Tokyo (JP)

( * ) Notice: Subject to any disclaimer, the term of this patent is extended or adjusted under 35 U.S.C. 154(b) by 132 days.

(21) Appl. No.: 15/940,170

(22) Filed: Mar. 29, 2018

(65) Prior Publication Data

US 2018/0286566 A1 Oct. 4, 2018

(30) Foreign Application Priority Data

Mar. 30, 2017 (JP) ..... 2017-067456

(51) Int. Cl.

| | |
|---|---|
| ***H01F 5/00*** | (2006.01) |
| ***H01F 27/28*** | (2006.01) |
| ***H01F 27/29*** | (2006.01) |
| ***H01F 41/04*** | (2006.01) |
| ***H01F 17/00*** | (2006.01) |

(52) U.S. Cl.

CPC ..... *H01F 27/2804* (2013.01); *H01F 17/0013* (2013.01); *H01F 27/29* (2013.01); *H01F 27/292* (2013.01); *H01F 41/041* (2013.01); *H01F 2017/0073* (2013.01); *H01F 2027/2809* (2013.01)

(58) Field of Classification Search

USPC ..... 336/200, 232, 192, 83

See application file for complete search history.

(56) References Cited

U.S. PATENT DOCUMENTS

| | | | | |
|---|---|---|---|---|
| 2006/0114094 | A1* | 6/2006 | Jean | H01F 27/027 336/182 |
| 2009/0058591 | A1* | 3/2009 | Nakada | H01F 1/344 336/221 |
| 2012/0236461 | A1 | 9/2012 | Yamamoto et al. | |
| 2012/0243143 | A1 | 9/2012 | Iwanaga et al. | |
| 2015/0009003 | A1 | 1/2015 | Ozawa et al. | |

(Continued)

FOREIGN PATENT DOCUMENTS

| | | | |
|---|---|---|---|
| CN | 1779871 | A | 5/2006 |
| CN | 102683012 | A | 9/2012 |

(Continued)

*Primary Examiner* — Elvin G Enad
*Assistant Examiner* — Kazi S Hossain
(74) *Attorney, Agent, or Firm* — Oliff PLC

(57) ABSTRACT

An electronic component includes an element body, a conductor, and a plated electrode layer. The element body includes a first outer surface provided with a first recess. The conductor includes a first conductor portion. The first conductor portion is disposed in the first recess and includes a first face opposed to a bottom face of the first recess and a second face opposed to the first face. The plated electrode layer includes a first plating portion covering the second face. The second face includes a first slope inclined with respect to the first outer surface in such a way as to be recessed toward the bottom face side of the first recess from the first outer surface.

10 Claims, 5 Drawing Sheets

(56) References Cited

U.S. PATENT DOCUMENTS

| | | | | |
|---|---|---|---|---|
| 2017/0004918 | A1 | 1/2017 | Kido et al. | |
| 2017/0103846 | A1 | 4/2017 | Yoneda | |
| 2017/0133146 | A1* | 5/2017 | Lee | H01F 27/292 |
| 2018/0096778 | A1* | 4/2018 | Yatabe | H01F 27/2804 |

FOREIGN PATENT DOCUMENTS

| | | | |
|---|---|---|---|
| CN | 106328339 | A | 1/2017 |
| JP | H08-064421 | A | 3/1996 |
| JP | 2002-305117 | A | 10/2002 |
| JP | 2012-204441 | A | 10/2012 |
| JP | 5888289 | B2 | 3/2016 |
| WO | 2016/006542 | A1 | 1/2016 |

* cited by examiner

ELECTRONIC COMPONENT

TECHNICAL FIELD

One aspect of the present invention relates to an electronic component.

BACKGROUND

Japanese Patent No. 5888289 discloses an electronic component including a laminate, an external electrode, an Ni plating layer and an Sn plating layer. The external electrode is embedded in the bottom face and the end face of the laminate. The Ni plating layer and the Sn plating layer are provided at a portion where the external electrode is exposed from the laminate. In this electronic component, by setting the thicknesses of the Ni plating layer and the Sn plating layer within a predetermined range, cracking and chipping in the laminate is suppressed.

SUMMARY

In the above electronic component, a phenomenon in which the plating layer peels off from the external electrode (plating peeling) can occur due to the tensile stress of the plating layer.

One aspect of the present invention is to provide an electronic component in which plating peeling can be suppressed.

An electronic component according to one aspect of the present invention includes an element body, a conductor, and a plated electrode layer. The element body includes a first outer surface provided with a first recess. The conductor includes a first conductor portion. The first conductor portion is disposed in the first recess and includes a first face opposed to a bottom face of the first recess and a second face opposed to the first face. The plated electrode layer includes a first plating portion covering the second face. The second face includes a first slope inclined with respect to the first outer surface in such a way as to be recessed toward the bottom face side of the first recess from the first outer surface.

In this electronic component, since the second face includes the first slope, the area of the second face is larger than the case in which the second face does not include the first slope, for example. Thus, the contact area between the second face and the first plating portion increases, and the adhesive strength between the second face and the first plating portion is improved. For this reason, plating peeling is suppressed. Since the first slope is inclined in such a way as to be recessed from the first outer surface, the size of the electronic component is easily kept to a predetermined size as compared with the case in which the first slope is inclined in such a way as to protrude from the first outer surface.

In the electronic component according to the aspect of the present invention, the first slope may be inclined in such a way that a distance between the first slope and the first outer surface in a direction orthogonal to the first outer surface increases as the first slope separates from an edge of the first recess. For example, when the conductor is obtained by heat-treating a conductor pattern containing a constituent material of the conductor and the element body is obtained by heat-treating an element-body pattern containing a constituent material of the element body, by increasing the resin amount of the conductor pattern more than the resin amount of the element-body pattern, it is possible to easily obtain the second face including such the first slope.

In the electronic component according to the aspect of the present invention, a distance between the second face and the first outer surface in the direction orthogonal to the first outer surface may be 6 μm or less. In this case, when the first plating portion is formed by, for example, barrel plating using a dummy ball, it is possible to easily contact the second face with the dummy ball as compared with the case in which the distance is longer than 6 μm. Thus, it is possible to easily form the first plating portion.

In the electronic component according to the aspect of the present invention, the first outer surface may be a mounting surface. In this case, when the electronic component is mounted on another electronic device, it is possible to easily achieve the electrical connection between the first conductor portion and the electronic device.

In the electronic component according to the aspect of the present invention, the element body may further include a second outer surface continuing from the first outer surface and provided with a second recess. The second recess may be provided continuously with the first recess. The conductor may further include a second conductor portion disposed in the second recess, and have an L-shaped cross section. In this case, when the electronic component is mounted on another electronic device by, for example, solder joint, solder is provided not only on the first outer surface which is the mounting surface but also on the second outer surface. Thus, it is possible to increase mounting strength.

In the electronic component according to the aspect of the present invention, the second conductor portion may include a third face opposed to a bottom face of the second recess and a fourth face opposed to the third face. The plated electrode layer may further include a second plating portion covering the fourth face. The fourth face may include a second slope inclined with respect to the second outer surface in such a way as to be recessed toward the bottom face side of the second recess from the second outer surface. In this case, since the fourth face includes the second slope, the area of the fourth face increases as compared with the case in which the fourth face does not include the second slope, for example. As a result, the contact area between the fourth face and the second plating portion increases, and the adhesive strength between the fourth face and the second plating portion is improved. Thus, plating peeling at the second plating portion is also suppressed. Since the second slope is inclined in such a way as to be recessed from the second outer surface, the size of the electronic component is easily kept to a predetermined size as compared with the case in which the second slope is inclined in such a way as to protrude from the second outer surface.

In the electronic component according to the aspect of the present invention, the plated electrode layer may include an Ni plating layer and an Au plating layer. The Ni plating layer contains Ni and covers the second face. The Au plating layer contains Au and covers the Ni plating layer. In this case, it is possible to reduce the electric resistance of the plated electrode layer.

DETAILED DESCRIPTION

Hereinafter, an embodiment will be described in detail with reference to the accompanying drawings. In the following description, the same reference sign is assigned to the same element or the element having the same function, and the redundant description will be omitted.

Figure 1:
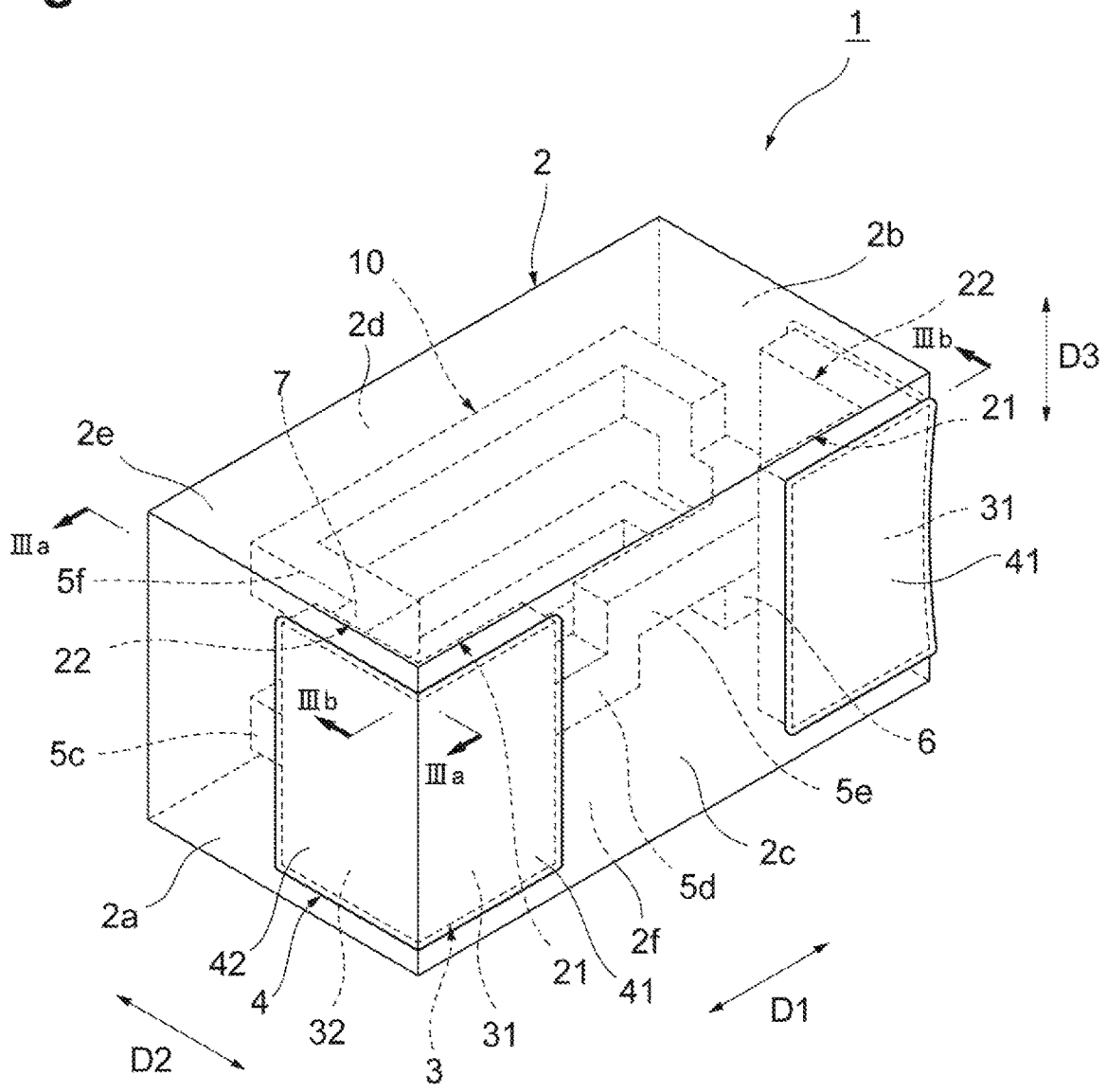
FIG. 1 is a perspective view of a laminated coil component according to an embodiment.
Figure 2:
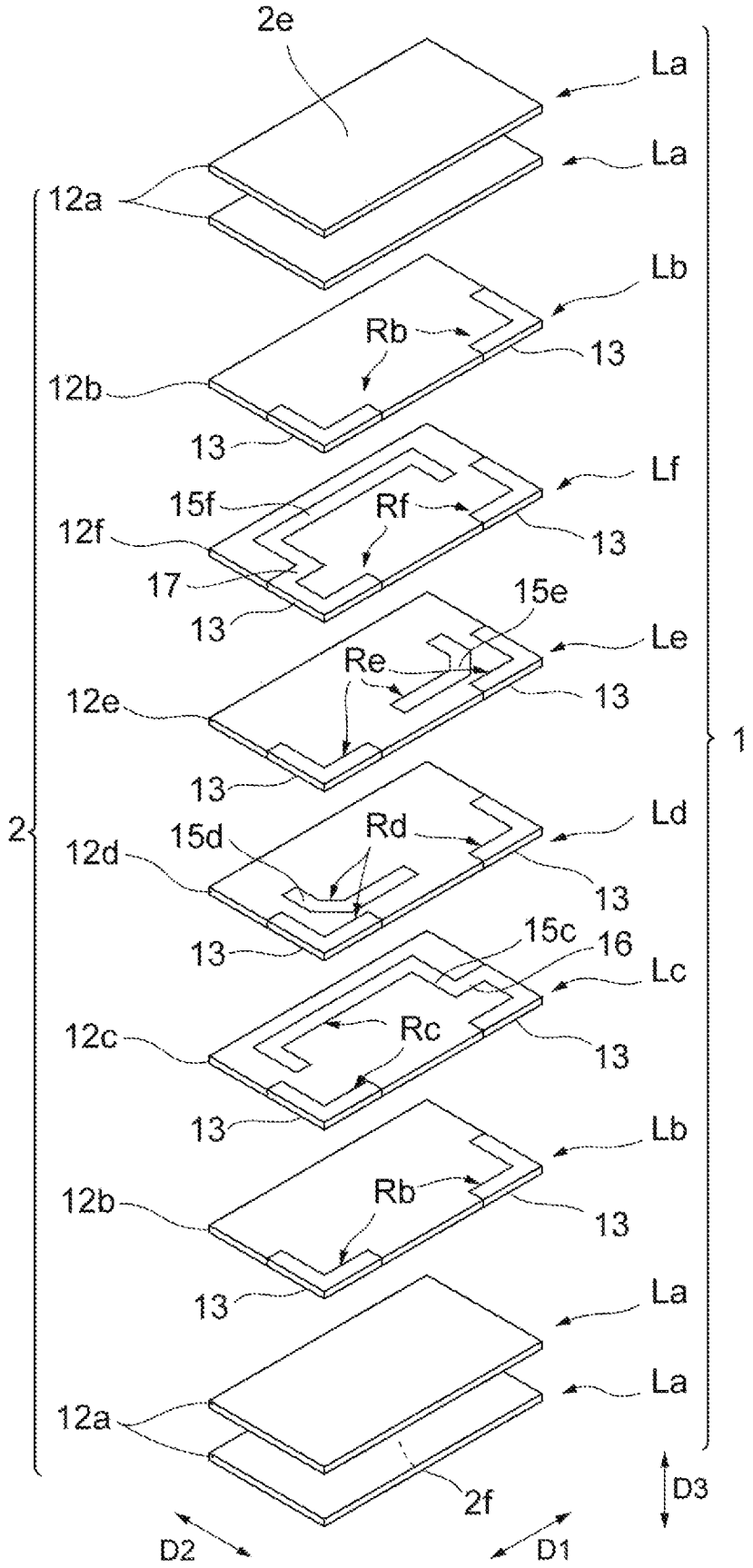
FIG. 2 is an exploded perspective view of the laminated coil component in FIG. 1.
Figure 3A:
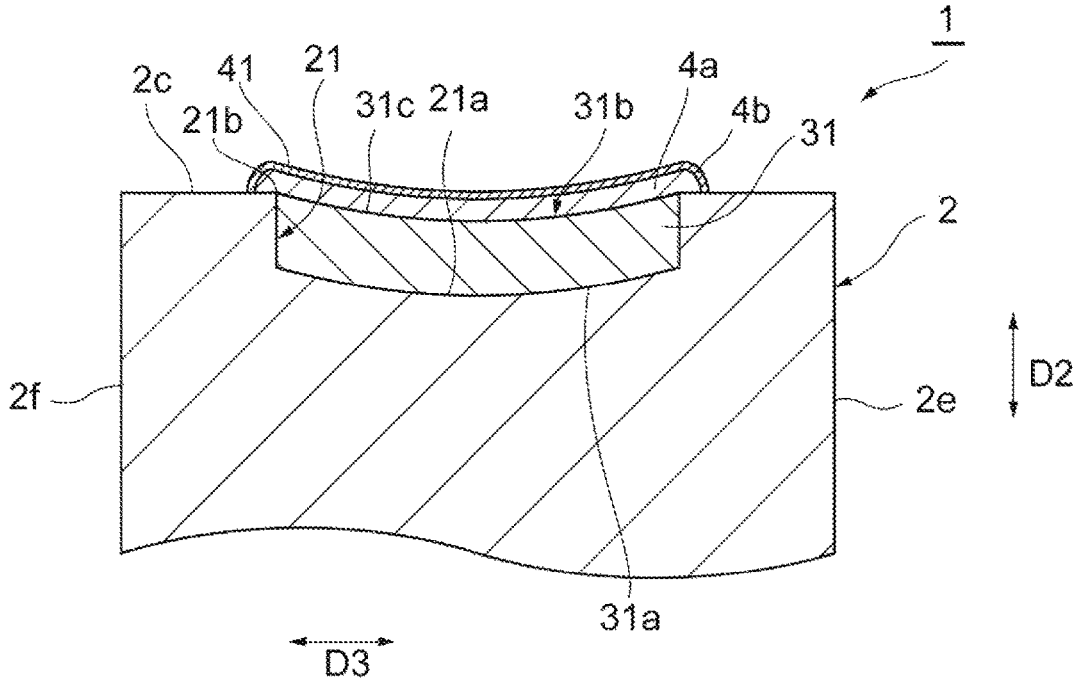
FIGS. 3A and 3B are cross-sectional views of the laminated coil component in FIG. 1.
Figure 3B:
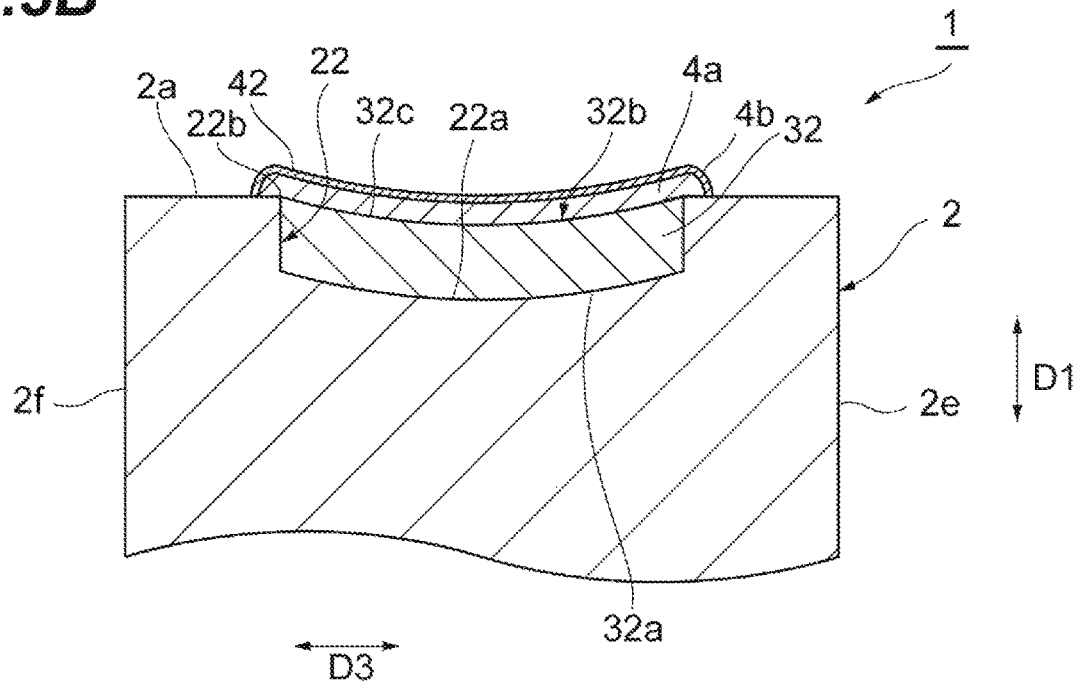

With reference to FIGS. 1, 2, 3A, and 3B, a laminated coil component according to an embodiment is described. FIG. 1 is a perspective view of the laminated coil component according to the embodiment. FIG. 2 is an exploded perspective view of the laminated coil component in FIG. 1. FIG. 3A is a cross-sectional view taken along line IIIa-IIIa of FIG. 1 FIG. 3B is a cross-sectional view taken along line of IIIa-IIIa of FIG. 1.

A laminated coil component 1 according to the embodiment includes an element body 2, a pair of conductors 3, a pair of plated electrode layers 4, a plurality of coil conductors 5*c*, 5*d*, 5*e*, and 5*f*, and connecting conductors 6 and 7.

The element body 2 has a rectangular parallelepiped shape. The rectangular parallelepiped shape includes a rectangular parallelepiped shape in which the corner portions and the ridge portions are chamfered, and a rectangular parallelepiped shape in which the corner portions and the ridge portions are rounded. The element body 2 includes end faces 2*a* and 2*b*, and side faces 2*c*, 2*d*, 2*e*, and 2*f* as the outer surfaces. The end faces 2*a* and 2*b* are opposed to each other. The side faces 2*c* and 2*d* are opposed to each other. The side faces 2*e* and 2*f* are opposed to each other. In the following description, it is assumed that the opposing direction of the end faces 2*a* and 2*b* is a direction D1, that the opposing direction of the side faces 2*c* and 2*d* is a direction D2, and that the opposing direction of the side faces 2*e* and 2*f* is a direction D3. The direction D1, the direction D2, and the direction D3 are substantially orthogonal to each other.

The end faces 2*a* and 2*b* extend in the direction D2 in such a way as to connect the side faces 2*c* and 2*d*. The end faces 2*a* and 2*b* also extend in the direction D3 in such a way as to connect the side faces 2*e* and 2*f*. The side faces 2*c* and 2*d* extend in the direction D1 in such a way as to connect the end faces 2*a* and 2*b*. The side faces 2*c* and 2*d* also extend in the direction D3 in such a way as to connect the side faces 2*e* and 2*f*. The side faces 2*e* and 2*f* extend in the direction D2 in such a way as to connect the side faces 2*c* and 2*d*. The side faces 2*e* and 2*f* also extend in the direction D1 in such a way as to connect the end faces 2*a* and 2*b*.

The side face 2*c* is a mounting surface and is opposed to another electronic device, which is not shown, (for example, a circuit substrate or an electronic component) when, for example, the laminated coil component 1 is mounted on the electronic device. The end faces 2*a* and 2*b* are faces continuing from the mounting surface (that is, the side face 2*c*).

The length of the element body 2 in the direction D1 is longer than the length of the element body 2 in the direction D2 and the length of the element body 2 in the direction D3. The length of the element body 2 in the direction D2 and the length of the element body 2 in the direction D3 are equivalent to each other. That is, in the present embodiment, the end faces 2*a* and 2*b* each have a square shape, and the side faces 2*c*, 2*d*, 2*e*, and 2*f* each have a rectangular shape. The length of the element body 2 in the direction D1 may be equivalent to the length of the element body 2 in the direction D2 and to the length of the element body 2 in the direction D3, or may be shorter than these lengths. The length of the element body 2 in the direction D2 and the length of the element body 2 in the direction D3 may be different from each other.

In the present embodiment, the term "equivalent" may include, in addition to being equal, a value including a slight difference or a manufacturing error in a preset range. For example, if a plurality of values is included within the range of ±5% of the average value of the values, the values are defined to be equivalent.

The element body 2 is provided with a pair of recesses 21 and a pair of recesses 22. One recess 21 and one recess 22 are continuously provided and correspond to one conductor 3. The other recess 21 and the other recess 22 are continuously provided and correspond to the other conductor 3.

The one recess 21 is provided on the side face 2*c* in such a way as to be adjacent to the end face 2*a* and is recessed toward the side face 2*d*. The other recess 21 is provided on the side face 2*c* in such a way as to be adjacent to the end face 2*b* and is recessed toward the side face 2*d*. Each recess 21 includes a bottom face 21*a*. The bottom face 21*a* has, for example, the same shape as a second face 31*b* to be described later. The bottom face 21*a* has complementary relationship with a first face 31*a* to be described later. The one recess 22 is provided on the end face 2*a* in such a way as to be adjacent to the side face 2*c* and is recessed toward the end face 2*b*. The other recess 22 is provided on the end face 2*b* in such a way as to be adjacent to the side face 2*c* and is recessed toward the end face 2*a*. Each recess 22 includes a bottom face 22*a*. The bottom face 22*a* has, for example, the same shape as a second face 32*b* to be described later. The bottom face 22*a* has complementary relationship with a first face 32*a* to be described later.

The recesses 21 and 22 have, for example, the same shape. The pair of recesses 21 and the pair of recesses 22 are provided in such a way as to be separated from the side faces 2*d*, 2*e*, and 2*f*. The pair of recesses 21 is provided in such a way as to be separated from each other in the direction D1.

The element body 2 is constituted by laminating a plurality of element-body layers 12*a* to 12*f* in the direction D3. A specific laminated structure will be described later. In the actual element body 2, the element-body layers 12*a* to 12*f* are integrated in such a way that no boundaries between the layers can be visually recognized. The element-body layers 12*a* to 12*f* include, for example, a magnetic material (Ni—Cu—Zn-based ferrite material, Ni—Cu—Zn—Mg-based ferrite material, Ni—Cu-based ferrite material, or the like). The magnetic material forming the element-body layers 12*a* to 12*f* may contain Fe alloy or the like. The element-body layers 12*a* to 12*f* may include a non-magnetic material (a glass ceramic material, a dielectric material, or the like).

Each conductor 3 is provided on the element body 2. Each conductor 3 is disposed in the recesses 21 and 22. Specifically, the one conductors 3 is disposed in the one recess 21 and the one recess 22, and the other conductor 3 is disposed in the other recess 21 and the other recess 22. Each conductor 3 has, for example, an L-shaped cross section. It can be also described that each conductor 3 has, for example, an L shape when viewed from the direction D3. The pair of conductors 3 is separated from each other in the direction D1. The pair of conductors 3 has, for example, the same shape.

Each conductor 3 is constituted by laminating, in the direction D3, a plurality of conductor layers 13 having an L shape when viewed from the direction D3. That is, the laminating direction of the conductor layers 13 is the direction D3. In the actual conductor 3, the conductor layers 13 are integrated in such a way that no boundaries between the layers can be visually recognized. The conductor 3 includes integrally formed conductor portions 31 and 32. The conductor portions 31 and 32 each have a substantially rectangular plate shape. The conductor portions 31 and 32 have, for example, the same shape.

Each conductor portion 31 is disposed in the recess 21. As particularly shown in FIG. 3A, each conductor portion 31 includes a first face 31*a* and a second face 31*b*. The first face 31*a* is opposed to the bottom face 21*a* in the direction D2. The second face 31*b* is opposed to the first face 31*a* in the direction D2.

The second face 31*b* includes a slope 31*c*. The slope 31*c* is inclined with respect to the side face 2*c* in such a way as to be recessed toward the bottom face 21*a* side from the side face 2*c*. The slope 31*c* is inclined in such a way that the distance between the slope 31*c* and the side face 2*c* in the direction D2 increases as the slope 31*c* separates from an edge 21*b* of the recess 21. The distance between the second face 31*b* and the side face 2*c* in the direction D2 is, for example, 6 μm or less. The slope 31*c* is, for example, a curved surface. The slope 31*c* may not be a curved surface. For example, the entire of the second face 31*b* is recessed toward the bottom face 21*a* side from a virtual plane including the side face 2*c*.

The first face 31*a* has, for example, a shape corresponding to the second face 31*b*. In other words, the first face 31*a* has a shape in which the distance between the first face 31*a* and the second face 31*b* in the direction D2 is to be constant (the thickness of the conductor portion 31 in the direction D2 is to be constant). For example, it can be said that the first face 31*a* has a complementary relationship with the second face 31*b* and the bottom face 21*a*.

Each conductor portion 32 is disposed in the recess 22. As particularly shown in FIG. 3B, the conductor portion 32 includes a first face 32*a* and a second face 32*b*. The first face 32*a* is opposed to the bottom face 22*a* in the direction D1. The second face 32*b* is opposed to the first face 32*a* in the direction D1. The first face 31*a* and the first face 32*a* intersect each other and are continuous. The second face 31*b* and the second face 32*b* intersect each other and are continuous.

The second face 32*b* includes a slope 32*c*. The slope 32*c* of one second face 32*b* is inclined with respect to the end face 2*a* in such a way as to be recessed toward the bottom face 22*a* side from the end face 2*a*. The slope 32*c* of the other second face 32*b* is inclined with respect to the end face 2*b* in such a way as to be recessed toward the bottom face 22*a* side from the end face 2*b*. The slope 32*c* is inclined in such a way that the distance between the slope 32*c* and the end face 2*a* or 2*b* in the direction D1 increases as the slope 32*c* separates from an edge 22*b* of the recess 22. The distance between the second face 32*b* and the end face 2*a* or 2*b* in the direction D1 is, for example, 6 μm or less. The slope 32*c* is, for example, a curved surface. The slope 32*c* may not be a curved surface. For example, the entire of the one second face 32*b* is recessed toward the bottom face 22*a* side from a virtual plane including the end face 2*a*. The entire of the other second face 32*b* is recessed toward the bottom face 22*a* side from a virtual plane including the end face 2*b*.

The first face 32*a* has, for example, a shape corresponding to the second face 32*b*. That is, the first face 32*a* has a shape in which the distance between the first face 32*a* and the second face 32*b* in the direction D1 is to be constant (the length of the conductor portion 32 in the direction D1 is to be constant). For example, it can be said that the first face 32*a* has a complementary relationship with the second face 32*b* and the bottom face 22*a*.

Each plated electrode layer 4 includes a plating portion 41 covering the second face 31*b* and a plating portion 42 covering the second face 32*b*. Each plated electrode layer 4 is formed by electrolytic plating or electroless plating. The plating portion 41 is formed in such a way as to be inclined along the slope 31*c* and have a constant thickness over the entire surface of the second face 31*b*. The plating portion 42 is formed in such a way as to be inclined along the slope 32*c* and have a constant thickness over the entire surface of the second face 32*b*.

Each plated electrode layer 4 contains, for example, nickel (Ni), gold (Au), tin (Sn) and the like. Each plated electrode layer 4 includes an Ni plating layer 4*a* and an Au plating layer 4*b*. The Ni plating layer 4*a* contains Ni and covers the second faces 31*b* and 32*b*. The Au plating layer 4*b* contains Au and covers the Ni plating layer 4*a*. Since each plated electrode layer 4 includes the Ni plating layer 4*a* and the Au plating layer 4*b*, the electric resistance of the electrode layer 4 can be reduced. The thickness of the Ni plating layer 4*a* is, for example, 6 μm. The thickness of the Au plating layer 4*b* is, for example, 0.1 μm.

The coil conductors 5*c*, 5*d*, 5*e*, and 5*f* are connected to each other to form a coil 10 in the element body 2. The coil axis of the coil 10 is provided along the direction D3. The coil conductors 5*c*, 5*d*, 5*e*, and 5*f* are disposed in such a way as to at least partially overlap each other when viewed from the direction D3. The coil conductors 5*c*, 5*d*, 5*e*, and 5*f* are disposed in such a way as to be separated from the end faces 2*a* and 2*b* and the side faces 2*c*, 2*d*, 2*e*, and 2*f*.

The coil conductor 5*c* includes a plurality of coil conductor layers 15*c* laminated in the direction D3. The coil conductor 5*d* includes a plurality of coil conductor layers 15*d* laminated in the direction D3. The coil conductor 5*e* includes a plurality of coil conductor layers 15*e* laminated in the direction D3. The coil conductor 5*f* includes a plurality of coil conductor layers 15*f* laminated in the direction D3. The plurality of the coil conductor layers 15*c* are disposed in such way as to entirely overlap each other when viewed from the direction D3. The plurality of the coil conductor layers 15*d* are disposed in such way as to entirely overlap each other when viewed from the direction D3. The plurality of the coil conductor layers 15*e* are disposed in such way as to entirely overlap each other when viewed from the direction D3. The plurality of the coil conductor layers 15*f* are disposed in such way as to entirely overlap each other when viewed from the direction D3. The coil conductor 5*c* may be constituted by a coil conductor layer 15*c*. The coil conductor 5*d* may be constituted by a coil conductor layer 15*d*. The coil conductor 5*e* may be constituted by a coil conductor layer 15*e*. The coil conductor 5*f* may be constituted by a coil conductor layer 15*f* FIG. 2 shows one each of the plurality of the coil conductor layers 15*c*, the plurality of the coil conductor layers 15*d*, the plurality of the coil conductor layers 15*e*, and the plurality of the coil conductor layers 15*f*. In the actual coil conductor 5*c*, the plurality of the coil conductor layers 15*c* are integrated in such a way that no boundaries between the layers can be visually recognized. In the actual coil conductor 5*d*, the plurality of the coil conductor layers 15*d* are integrated in such a way that no boundaries between the layers can be visually recognized. In the actual coil conductor 5*e*, the plurality of the coil conductor layers 15*e* are integrated in such a way that no boundaries between the layers can be visually recognized. In the actual coil conductor 5*f*, the plurality of the coil conductor layers 15*f* are integrated in such a way that no boundaries between the layers can be visually recognized.

The connecting conductor 6 extends along the direction D1. The connecting conductor 6 is connected to the coil conductor 5*c* and the other conductor portion 32. The connecting conductor 7 extends along the direction D1. The connecting conductor 7 is connected to the coil conductor 5*f* and the one conductor portion 32. The connecting conductor 6 includes a plurality of connecting conductor layers 16 laminated in the direction D3. The connecting conductor 7 includes a plurality of connecting conductor layers 17 laminated in the direction D3. In FIG. 2, one of the plurality of the connecting conductor layers 16 and one of the plurality of the connecting conductor layers 17 are shown. In the actual connecting conductor 6, the plurality of the connecting conductor layers 16 are integrated in such a way that no boundaries between the layers can be visually recognized. In the actual connecting conductor 7, the plurality of the connecting conductor layers 17 are integrated in such a way that no boundaries between the layers can be visually recognized.

The conductor layers 13, the coil conductor layers 15*c*, 15*d*, 15*e*, and 15*f*, and the connecting conductor layers 16 and 17 includes a conductive material (for example, Ag or Pd). Each layer may include the same material or different materials. Each layer has a substantially rectangular cross section.

The laminated coil component 1 includes layers La, Lb, Lc, Ld, Le, and Lf. For example, the laminated coil component 1 is constituted by laminating, from the side face 2*f* side, two layers La, one layer Lb, three layers Lc, three layers Ld, three layers Le, three layers Lf, one layer Lb, and two layers La, in this order. FIG. 2 shows one of the three layers but not the other two layers for each of the three layers Lc, the three layers Ld, the three layers Le, and the three layers Lf.

The layer La is constituted by the element-body layer 12*a*.

The layer Lb is constituted by combining the element-body layer 12*b* and a pair of conductor layers 13 with each other. The element-body layer 12*b* is provided with a defect portion Rb. The defect portion Rb has shapes corresponding to the respective shapes of the pair of conductor layers 13. The pair of conductor layers 13 is fitted into the defect portion Rb. The element-body layer 12*b* and the pair of conductor layers 13 have mutually complementary relationship as a whole.

The layer Lc is constituted by combining the element-body layer 12*c*, a pair of conductor layers 13, and the coil conductor layer 15*c* with each other. The element-body layer 12*c* is provided with a defect portion Rc. The defect portion Rc has shapes corresponding to the respective shapes of the pair of conductor layers 13, the coil conductor layer 15*c*, and the connecting conductor layer 16. The pair of the conductor layers 13, the coil conductor layer 15*c*, and the connecting conductor layer 16 are fitted into the defect portion Rc. The element-body layer 12*c*, the pair of conductor layers 13, the coil conductor layer 15*c*, and the connecting conductor layer 16 have mutually complementary relationship as a whole.

The layer Ld is constituted by combining the element-body layer 12*d*, a pair of conductor layers 13, and the coil conductor layer 15*d* with each other. The element-body layer 12*d* is provided with a defect portion Rd. The defect portion Rd has shapes corresponding to the respective shapes of the pair of conductor layers 13, and the coil conductor layer 15*d*. The pair of conductor layers 13, and the coil conductor layer 15*d* are fitted into the defect portion Rd. The element-body layer 12*d*, the pair of conductor layers 13, and the coil conductor layer 15*d* have mutually complementary relationship as a whole.

The layer Le is constituted by combining the element-body layer 12*e*, a pair of conductor layers 13, and the coil conductor layer 15*e* with each other. The element-body layer 12*e* is provided with a defect portion Re. The defect portion Re has shapes corresponding to the respective shapes of the pair of conductor layers 13, and the coil conductor layer 15*e*. The pair of conductor layers 13, and the coil conductor layer 15*e* are fitted into the defect portion Re. The element-body layer 12*e*, the pair of conductor layers 13, and the coil conductor layer 15*e* have mutually complementary relationship as a whole.

The layer Lf is constituted by combining the element-body layer 12*f*, a pair of conductor layers 13, the coil conductor layer 15*f*, and the connecting conductor layer 17 with each other. The element-body layer 12*f* is provided with a defect portion Rf. The defect portion Rf has shapes corresponding to the respective shapes of the pair of conductor layers 13, the coil conductor layer 15*f*, and the connecting conductor layer 17. The pair of the conductor layers 13, the coil conductor layer 15*f*, and the connecting conductor layer 17 are fitted into the defect portion Rf. The element-body layer 12*f*, the pair of conductor layers 13, the coil conductor layer 15*f*, and the connecting conductor layer 17 have mutually complementary relationship as a whole.

The defect portions Rb, Rc, Rd, Re, and Rf are integrated to constitute the pair of recesses 21 and pair of recesses 22. The widths of the defect portions Rb, Rc, Rd, Re, and Rf (hereinafter, the width of the defect portion) are basically set in such a way as to be wider than the those of the conductor layers 13, the coil conductor layers 15*c*, 15*d*, 15*e*, and 15*f*, and the connecting conductor layers 16 and 17 (hereinafter, the width of the conductor portion). The width of the defect portion may be intentionally set in such a way as to be narrower than the width of the conductor portion in order for the element-body layers 12*b*, 12*c*, 12*d*, 12*e*, and 12*f* to adhere to the conductor layers 13, the coil conductor layers 15*c*, 15*d*, 15*e*, and 15*f*, and the connecting conductor layers 16 and 17 more firmly. The value obtained by subtracting the width of the conductor portion from the width of the defect portion is preferably, for example, −3 μm or more and 10 μm or less, and more preferably 0 μm or more and 10 μm or less.

An example of a method for manufacturing the laminated coil component 1 according to the embodiment is described.

First, an element-body paste containing the constituent material of the element-body layers 12*a* to 12*f* and a photosensitive material is applied on a substrate (for example, a PET film). An element-body forming layer is thereby formed. The photosensitive material contained in the element-body paste may be either a negative type or a positive type, and a known photosensitive material can be used. Then, the element-body forming layer is exposed and developed by, for example, a photolithography method using a Cr mask. An element-body pattern from which a shape corresponding to the shape of a conductor forming layer to be described later is removed is thereby formed on the substrate. The element-body pattern is a layer to be each of the element-body layers 12*b*, 12*c*, 12*d*, 12*e*, and 12*f* after heat treatment. That is, the element-body pattern provided with defect portions to be the defect portions Rb, Re, Rd, Re, and Rf is formed. Note that, the "photolithography method" in the present embodiment is only required to be a method for forming a desired pattern by exposing and developing a layer to be patterned containing a photosensitive material, and is not limited to the type of mask or the like.

On the other hand, a conductor paste containing the constituent materials of the above conductor layer 13, the coil conductor layers 15*c*, 15*d*, 15*e*, and 15*f*, and the connecting conductor layers 16 and 17, and a photosensitive material is applied on a substrate (for example, a PET film). A conductor forming layer is thereby formed. The photosensitive material contained in the conductor paste may be either a negative type or a positive type, and a known photosensitive material can be used. Then, the conductor forming layer is exposed and developed by, for example, a photolithography method using a Cr mask. A conductor pattern is thereby formed on the substrate. The conductor pattern is a layer to be each of the conductor layer 13, the coil conductor layers 15*c*, 15*d*, 15*e*, and 15*f*, and the connecting conductor layers 16 and 17 after the heat treatment.

Then, the element-body forming layer is transferred from the substrate onto a supporting body. In the present embodiment, the step of transferring the element-body forming layer is repeated twice. Two element-body forming layers are thereby laminated on the supporting body. These element-body forming layer are layers to be the layer La after the heat treatment.

Then, the conductor pattern and the element-body pattern are repeatedly transferred onto the supporting body. The conductor patterns and the element-body patterns are thereby laminated in the direction D3. Specifically, first, the conductor pattern is transferred from the substrate onto the element-body forming layer. Next, the element-body pattern is transferred from the substrate onto the element-body forming layer. The conductor pattern is combined with the defect portion of the element-body pattern, and the element-body pattern and the conductor pattern are in the same layer on the element-body forming layer. The step of transferring the conductor pattern and element-body pattern is further repeated. The conductor pattern and the element-body pattern are thereby laminated in a state of being combined with each other. The layers to be the layers Lb, Lc, Ld, Le, and Lf after the heat treatment are thereby laminated.

Then, the element-body forming layer is transferred from the substrate onto the layers laminated in the steps of transferring the conductor pattern and the element-body pattern. In the present embodiment, the step of transferring the element-body forming layer is repeated twice. Two element-body forming layers are thereby laminated on the layer. These element-body forming layer are layers to be the layer La after the heat treatment.

As described above, a laminate to be a portion other than the plated electrode layer 4 of the laminated coil component 1 after the heat treatment is formed on the supporting body. Then, the obtained laminate is cut into a predetermined size. Thereafter, the cut laminate is subjected to debinding treatment, and then subjected to the heat treatment. The temperature of the heat treatment is, for example, about 850 to 900° C. By the heat treatment, the second faces 31*b* and 32*b* of the conductor 3 are inclined to include the slopes 31*c* and 32*c*. For example, by increasing the resin amount of the conductor paste more than the resin amount of the element-body paste to make the contraction rate of the conductor pattern larger than the contraction rate of the element-body pattern, it is possible to form such slopes 31*c* and 32*c*. Then, electrolytic plating or electroless plating is performed to form the plated electrode layer 4 on the second faces 31*b* and 32*b* of the conductor 3. The laminated coil component 1 is thereby obtained.

Figure 4A:
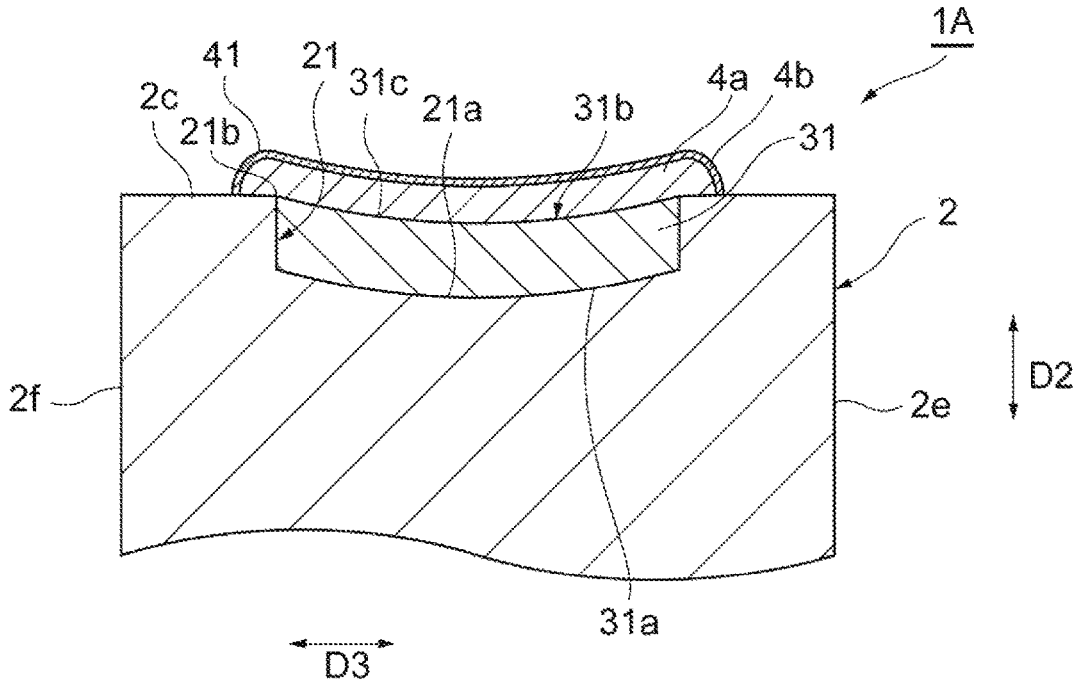
FIGS. 4A and 4B are cross-sectional views of a laminated coil component according to a modified example.
Figure 4B:
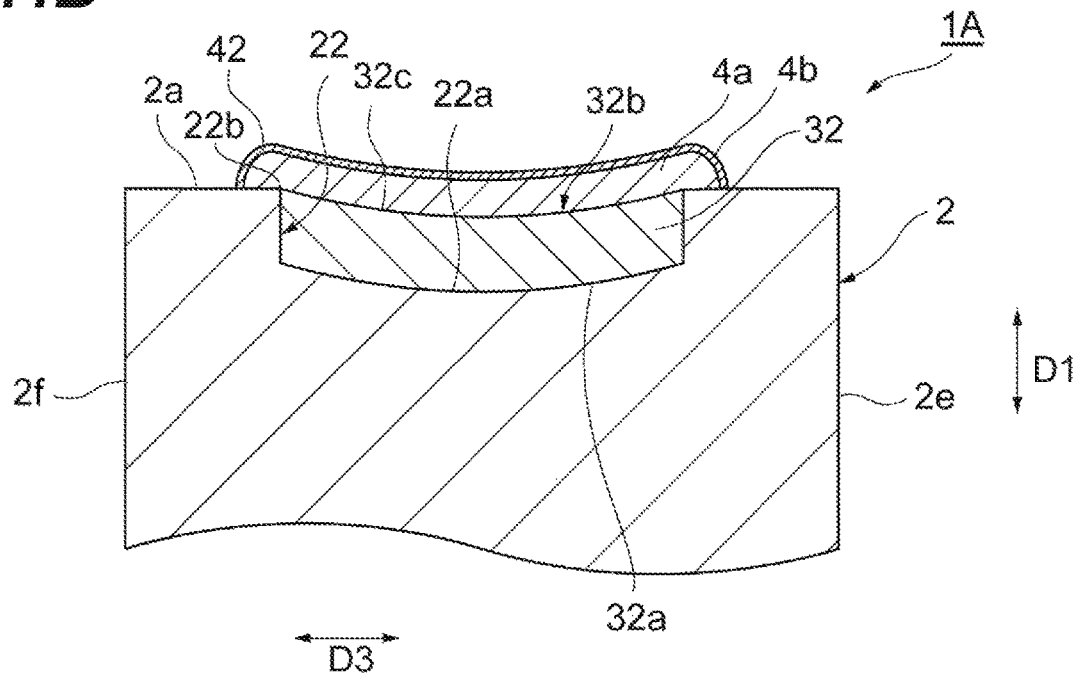

FIGS. 4A and 4B are cross-sectional views of a laminated coil component according to a modified example. A laminated coil component 1A according to the modified example is different from the laminated coil component 1 in that the plated electrode layer 4 is thickened.

Figure 5A:
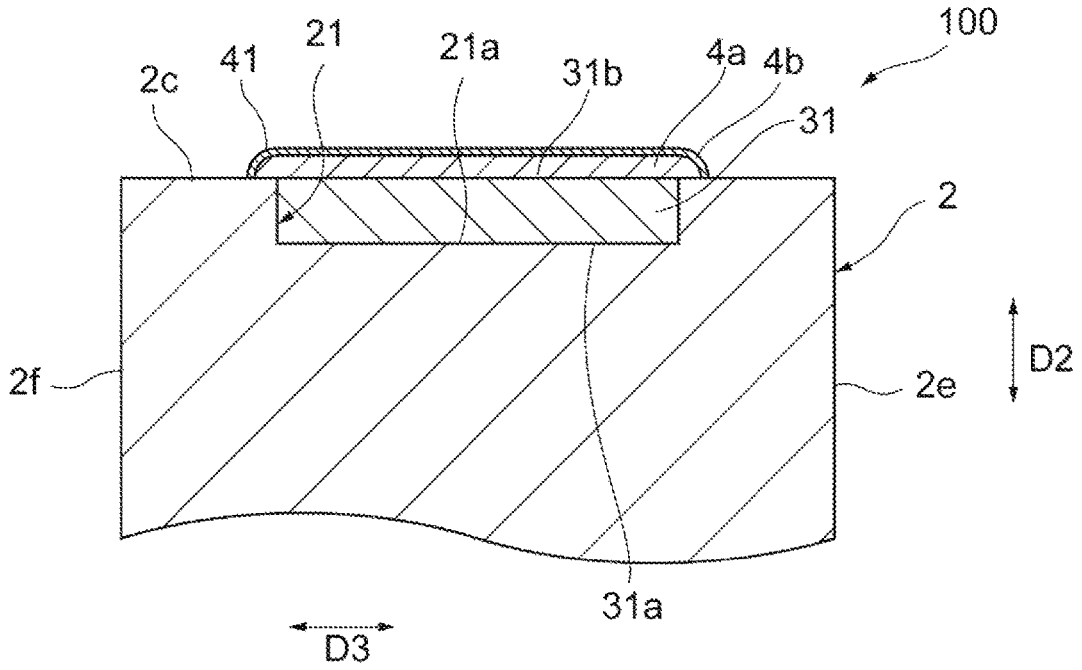
FIGS. 5A and 5B are cross-sectional views of the laminated coil component according to a comparative example.
Figure 5B:
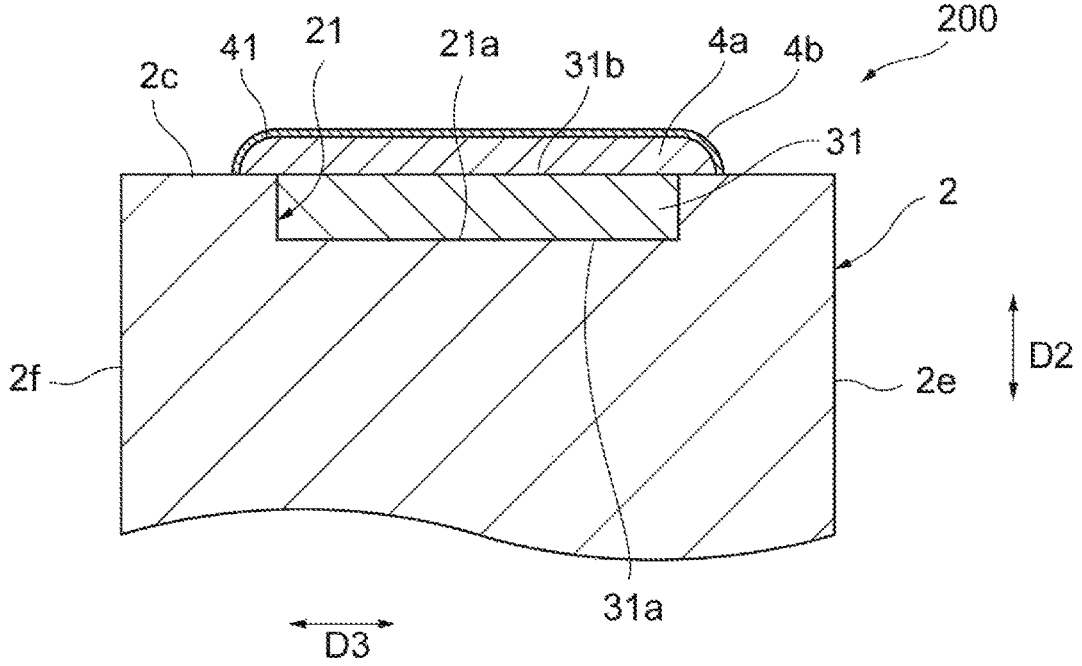

FIGS. 5A and 5B are cross-sectional views of laminated coil components according to a first comparative example and a second comparative example. A laminated coil component 100 according to the first comparative example shown in FIG. 5A is different from the laminated coil component 1 in that the bottom faces 21*a* and 22*a*, the first faces 31*a* and 32*a*, the second faces 31*b* and 32*b*, and the plating portions 41 and 42 are not inclined. The bottom face 22*a*, the first face 32*a*, the second face 32*b*, and the plating portion 42 of the laminated coil component 100 are not shown.

A laminated coil component 200 according to the second comparative example shown in FIG. 5B is different from the laminated coil component 1A in that the bottom faces 21*a* and 22*a*, the first faces 31*a* and 32*a*, the second faces 31*b* and 32*b*, and the plating portions 41 and 42 are not inclined. The bottom face 22*a*, the first face 32*a*, the second face 32*b*, and the plating portion 42 of the laminated coil component 200 are not shown.

In the laminated coil component 1, the second faces 31*b* and 32*b* include the slopes 31*c* and 32*c* respectively. Thus, the areas of the second faces 31*b* and 32*b* is larger than those of the laminated coil component 100. Accordingly, the contact area between the second face 31*b* and the plating portion 41, and the contact area between the second face 32*b* and the plating portion 42 are increased. Thus, the adhesive strength between the second face 31*b* and the plating portion 41, and the adhesive strength between the second face 32*b* and the plating portion 42 are improved. For this reason, according to the laminated coil component 1, plating peeling is suppressed.

In each of the laminated coil components 1A and the laminated coil component 200, since the plated electrode layer 4 is thickened, the tensile stress of the plated electrode layer 4 is increased, and plating peeling easily occur. In the laminated coil component 1A, since the second faces 31*b* and 32*b* include the slopes 31*c* and 32*c* respectively, plating peeling is suppressed as compared with the laminated coil component 200.

In each of the laminated coil components 1 and 1A, the second faces 31*b* and 32*b* include slopes 31*c* and 32*c* respectively which are inclined in such a way as to be recessed. Thus, as compared with the case in which the second faces 31*b* and 32*b* include slopes which are inclined in such a way as to protrude, the size of each of the laminated coil components 1 and 1A can be easily kept to a predetermined size.

The slope 31*c* is inclined in such a way that the distance between the slope 31*c* and the side face 2*c* in the direction D2 increases as the slope 31*c* separates from an edge 21*b* of the recess 21. The slope 32*c* is inclined in such a way that the distance between the slope 32*c* and the end face 2*a* or 2*b* in the direction D1 increases as the slope 32*c* separates from an edge 22*b* of the recess 22. The conductor 3 is obtained by heat-treating a conductor pattern formed using a conductor paste. The element body 2 is obtained by heat-treating an element-body pattern fainted using an element-body paste. Thus, by increasing the resin amount of the conductor paste more than the resin amount of the element-body paste to make the contraction rate of the conductor pattern larger than the contraction rate of the element-body pattern, it is possible to easily form the second faces 31*b* and 32*b* including the slopes 31*c* and 32*c* respectively. In the present embodiment, since the second face 31*b* and the second face 32*b* are continuous, the center portions of the entire second face 31*b* and the entire second face 32*b* are most easily recessed. The most recessed portion in the second face 31*b* is, for example, a portion from the center portion of the second face 31*b* to the corner portion which forms the boundary between the second face 31*b* and the second face 32*b*. The most recessed portion in the second face 32*b* is, for example, a portion from the center portion of the second face 32*b* to the corner portion which forms the boundary between the second face 31*b* and the second face 32*b*. Thus, when each of the laminated coil components 1 and 1 A is mounted on another electronic device by, for example, solder joint, the solder from the center portion of the second face 31*b* to the center portion of the second face 32*b* is most thickened, and the solder is in a state of being held by the entire second faces 31*b* and 32*b*. That is, solder easily collects on the second faces 31*b* and 32*b*, and the solder is easily held by the second faces 31*b* and 32*b*. Thus, it is possible to stably mount each of the laminated coil components 1 and 1A.

The distance between the second face 31*b* and the side face 2*c* in the direction D2 and the distance between the second face 32*b* and the end face 2*a* or 2*b* in the direction D1 each are 6 μm or less. Thus, when the plating portion 41 and the plating portion 42 are formed by, for example, barrel plating using a dummy ball, it is possible to easily contact the second face 31*b* or 32*b* with the dummy ball as compared with the case in which the distance is longer than 6 μm. As a result, it is possible to easily form the plating portion 41 and the plating portion 42.

The element body 2 includes the side face 2*c* which is the mounting surface. The recess 21 in which the conductor portion 31 is disposed is provided on the side face 2*c*. Thus, when each of the laminated coil components 1 and 1A is mounted on another electronic device, it is possible to easily achieve the electrical connection between the conductor portion 31 and the electronic device.

The element body 2 includes the end faces 2*a* and 2*b* continuing from the side face 2*c*. The end faces 2*a* and 2*b* each are provided with the recess 22. The conductor 3 includes the conductor portion 32 disposed in the recess 22 and has an L-shaped cross section. Thus, when each of the laminated coil components 1 and 1A is mounted on another electronic device by, for example, solder joint, since the solder is provided not only on the side face 2*c* but also on the end faces 2*a* and 2*b*, it is possible to further improve the mounting strength.

The present invention is not limited to the above embodiment, and various modifications can be made.

Each of the laminated coil components 1 and 1A may further include a core portion inside the coil 10 when viewed from the direction D3. The core portion may be hollow. That is, the laminated coil component 1 may be an air-core coil. The core portion may be solid and include, for example, a magnetic material different from the constituent material of the element body 2. The core portion may penetrate the element body 2 in the direction D3. The core portion may be covered with the element body 2 at both end portions in the direction D3. The laminated coil component 1 may further include spacers disposed between the coil conductors 5*c*, 5*d*, 5*e*, and 5*f* in the direction D3. In this case, the spacer may include, for example, a magnetic material or a non-magnetic material different from the constituent material of the element body 2.

In each of the laminated coil components 1 and 1A, the conductor 3 is only required to include either the conductor portion 31 or 32. In this case, the element body 2 may be provided with either the recess 21 or 22 in correspondence with the conductor portion 31 or 32. The second face 31*b* is only required to include the slope 31*c*, and may include a face that is not inclined with respect to the side face 2*c*. The second face 32*b* is only required to include the slope 32*c*, and may include a face that is not inclined with respect to the end face 2*a* or 2*b*.

In each of the laminated coil components 1 and 1A, the first faces 31*a* and 32*a* and the bottom faces 21*a* and 22*a* may not be inclined. The thicknesses of the conductor portions 31 and 32 may not be constant.

In the embodiment described above, the laminated coil component 1 has been described as an example of an electronic component, but the present invention is not limited to this, and can be applied to other electronic components such as multilayer ceramic capacitors, laminated varistors, laminated piezoelectric actuators, laminated thermistors, and laminated composite components.

What is claimed is:

1. An electronic component comprising:

an element body including a first outer surface (1) provided with a first recess and a non-recessed portion and (2) configured to be a mounting surface;

a conductor including (1) a first conductor portion disposed in the first recess that includes (a) a first face opposed to a bottom face of the first recess and (b) a second face opposed to the first face and (2) a plurality of laminated conductor layers; and a plated electrode layer including a first plating portion covering the second face, wherein the bottom face of the first recess, the second face and the first plating portion are all sloped inwardly with respect to the non-recessed portion.

2. The electronic component according to claim 1, wherein the bottom face of the first recess, the second face and the first plating portion are inclined in such a way that a distance between the bottom face of the recess and the non-recessed portion in a direction orthogonal to the first outer surface increases as the distance laterally from the non-recessed portion increases.

3. The electronic component according to claim 1, wherein a distance between the second face and the first outer surface in a direction orthogonal to the first outer surface is 6 μm or less.

4. The electronic component according to claim 1, wherein the element body further includes a second outer surface continuing from the first outer surface and provided with a second recess, the second recess is provided continuously with the first recess, and the conductor further includes a second conductor portion disposed in the second recess, and has an L-shaped cross section.

5. An electronic component comprising:

an element body including a first outer surface provided with a first recess;

a conductor including a first conductor portion disposed in the first recess and including a first face opposed to a bottom face of the first recess and a second face opposed to the first face; and a plated electrode layer including a first plating portion covering the second face, wherein:

the second face includes a first slope inclined with respect to the first outer surface in such a way as to be recessed toward the bottom face side of the first recess from the first outer surface;

the first outer surface is a mounting surface;

the element body further includes a second outer surface continuing from the first outer surface and provided with a second recess;

the second recess is provided continuously with the first recess;

the conductor further includes a second conductor portion disposed in the second recess, and has an L-shaped cross section;

the second conductor portion includes a third face opposed to a bottom face of the second recess and a fourth face opposed to the third face;

the plated electrode layer further includes a second plating portion covering the fourth face; and the fourth face includes a second slope inclined with respect to the second outer surface in such a way as to be recessed toward the bottom face side of the second recess from the second outer surface.

6. The electronic component according to claim 1, wherein the plated electrode layer includes an Ni plating layer containing Ni and covering the second face, and an Au plating layer containing Au and covering the Ni plating layer.

7. The electronic component according to claim 1, wherein the element body is comprised of a plurality of laminated element body layers.

8. The electronic component according to claim 7, wherein the first recess is formed in two or more of the laminated conductor layers before lamination.

9. The electronic component according to claim 1, wherein the plurality of laminated conductor layers are laminated in a direction orthogonal to the first face and the second face.

10. The electronic component according to claim 9, wherein:

an entire length and width of the bottom face is sloped and in contact with the first face; and the conductor does not cover the non-recessed portion.

* * * * *